US010352054B2

(12) United States Patent
Velet et al.

(10) Patent No.: US 10,352,054 B2
(45) Date of Patent: Jul. 16, 2019

(54) PORTABLE KIDDIE POOL

(71) Applicant: Polygroup Macau Limited (BVI), Road Town, Tortola (VG)

(72) Inventors: Alex Lei Velet, Westlake, OH (US); Trevor L. Jackson, Kirtland, OH (US); Nicholas Emile Stanca, Westlake, OH (US); Jess Paul Carlson, Chagrin Falls, OH (US); David Michael Pehar, Willoughby, OH (US)

(73) Assignee: Polygroup Macau Limited (BVI), Road Town (VG)

( * ) Notice: Subject to any disclaimer, the term of this patent is extended or adjusted under 35 U.S.C. 154(b) by 4 days.

(21) Appl. No.: 15/143,755

(22) Filed: May 2, 2016

(65) Prior Publication Data

US 2017/0314280 A1 Nov. 2, 2017

Related U.S. Application Data

(63) Continuation of application No. 15/143,661, filed on May 2, 2016.

(51) Int. Cl.

| | |
|---|---|
| ***E04H 4/00*** | (2006.01) |
| ***E04H 4/12*** | (2006.01) |
| ***B05B 17/08*** | (2006.01) |

(52) U.S. Cl.

CPC ..... *E04H 4/0031* (2013.01); *B05B 17/08* (2013.01); *E04H 4/0037* (2013.01); *E04H 4/12* (2013.01); *E04H 2004/0068* (2013.01)

(58) Field of Classification Search

CPC ..... B05B 17/08–085; B05B 1/16; B05B 1/1627–1663; B05B 1/1672; E04H 2004/0068; E04H 4/0037; E04H 4/12; E04H 4/14

USPC ..... 239/16–23; 4/488–513

See application file for complete search history.

(56) References Cited

U.S. PATENT DOCUMENTS

| | | | | |
|---|---|---|---|---|
| 1,939,803 | A * | 12/1933 | Cataldi | B05B 3/0422 239/17 |
| 2,530,808 | A * | 11/1950 | Cerasi | B05B 1/265 239/440 |
| 2,877,051 | A * | 3/1959 | Cushman | B05B 17/08 119/255 |
| 4,174,808 | A * | 11/1979 | Latin | B05B 17/08 239/23 |

(Continued)

*Primary Examiner* — David P Angwin
*Assistant Examiner* — Nicholas A Ros
(74) *Attorney, Agent, or Firm* — Troutman Sanders LLP; Ryan A. Schneider; Christopher C. Close, Jr.

(57) ABSTRACT

A portable kiddie pool includes a main basin including a floor and a perimeter wall defining a perimeter of the pool, the floor including a radial groove that extends towards the perimeter of the pool, a fountain basin disposed above the floor within a perimeter of the perimeter wall, the fountain basin including at least one fountain opening, and tubing that extends at a first end from the perimeter of the pool through the radial groove of the floor to a second end that operably connects to the at least one fountain opening of the fountain basin, the tubing including a fitting configured to connect to a pressurized water source such that water from the pressurized water source flows from the pressurized water source through the tubing and to the fountain opening of the fountain basin.

17 Claims, 14 Drawing Sheets

(56) References Cited

U.S. PATENT DOCUMENTS

| | | | | | |
|---|---|---|---|---|---|
| 4,416,420 | A * | 11/1983 | Thompson | B05B 17/08 | 239/22 |
| 4,510,632 | A * | 4/1985 | Elsis | E04H 4/0037 | 4/488 |
| 4,591,094 | A * | 5/1986 | Morris | B05B 17/08 | 239/17 |
| 4,642,822 | A * | 2/1987 | Tvengsberg | A63B 43/04 | 4/488 |
| 5,135,440 | A * | 8/1992 | Smollar | A63G 31/007 | 472/128 |
| 5,524,399 | A * | 6/1996 | Reum | E04H 4/0037 | 4/492 |
| 5,530,972 | A * | 7/1996 | Tanner | A61H 35/02 | 239/590 |
| 6,684,813 | B1 * | 2/2004 | Lemon | A01K 45/002 | 119/69.5 |
| 6,755,349 | B2 * | 6/2004 | Beidokhti | B05B 17/08 | 239/16 |
| 6,848,628 | B2 * | 2/2005 | Walker | B05B 17/08 | 239/16 |
| 8,522,372 | B1 * | 9/2013 | Lafon | B05B 17/08 | 239/18 |
| 2004/0069860 | A1 * | 4/2004 | Nary | B05B 17/08 | 239/17 |

* cited by examiner

PORTABLE KIDDIE POOL

FIELD OF THE INVENTION

The present disclosure relates generally to pools. In particular, the present disclosure relates to kiddie pools or children's pools that are portable, easily transportable and storable. The present disclosure, however, is not limited to pools.

BACKGROUND

Children's pools have become a popular form of entertainment for children of certain age groups (e.g., under 5 years). In general, on sunny, hot days kiddie pools installed or placed in the yard of their own homes allow children to splash, stay cool and spend fun-filled quality time with their parents or caregivers while getting exercise and fresh air. Kiddie pools have an added benefit of introducing infants or young children to water without having to expose them to the depth or width of adult-sized pools, and thus, allowing them to get accustomed to being in the water in preparation for learning how to swim later. Kiddie pools come in a variety of sizes in consideration of the yard size and the age of the children.

Because they are typically installed or placed outside of homes and exposed to the sun for hours in the summer, kiddie pools must be made of materials that withstand the hot summer heat as well as the weight of water and children for hours at a time. Further, kiddie pools come in a variety of sizes to accommodate varying numbers of children at differing occasions.

Issues with current pools include issues with packaging, transporting and storage of the kiddie pools which are difficult for manufacturers and distributors with current designs. Other concerns with currently available kiddie pools are the difficulty of connecting and disconnecting the pool to the water source and that draining of the water is a tedious process requiring either manually bailing water from the pool or physically lifting a pool full of water high enough to remove the water over the edge of the pool. Another issue is the limited entertainment features built into the pools.

SUMMARY OF THE INVENTION

The present disclosure relates to a manufacture such as a kiddie pool that may offer a variety of entertainment for young children. The kiddie pool includes a fountain basin attachable to the main basin of the kiddie pool via a pedestal of the main basin. It may also include a hose or tubing that is integrated partly in a radial groove which runs from one end of the main basin to the fountain basin which, in turn, sprays the water in various patterns, e.g., fan, shower, flat, cone, mist, jet, wave, etc. The integrated hose or tubing may have a quick connect/disconnect fitting or attachment to easily connect and or disconnect to a garden hose which may be, in turn, connected to a water source. The kiddie pool may have various operation modes, e.g., a main basin filling mode and a fountain basin filling mode. When in use, the kiddie pool manifests a fountain feature: water is directed from under the main basin and up through the main basin to the fountain basin. Then, pressurized water from the water source via the integrated hose or tubing may spray upwards to create a fountain.

In particular, when the kiddie pool is in a main basin filling mode, a user may rotate the fountain basin to change spray patterns on the fountain to various different setting (e.g., fan, shower, flat, cone, mist, jet, wave, etc.), resembling popular water shows offered by amusement parks, parks or hotels. Hence, in addition to regular splashes and cooling-off, children are exposed to a variety of creative water patterns that can mesmerize the children for hours, and thus, easily forgetting the heat of the summer and providing a fun activity. Rotating the fountain basin, in addition to changing the spray pattern, also produces a clicking sound that provides feedback to the user.

In the fountain basin filling mode, the system of corresponding troughs and holes/slots of the fountain basin and the main basin are closed, and thus allowing filling of the fountain basin with water. The fountain basin filling mode adds more entertainment to the children by presenting tiers of water, i.e. the first tier of water in the main basin where children's lower bodies get cooled and the second tier of water in the fountain basin for children to cool off their hands and conveniently splash others with the fountain basin water. When the fountain basin is operating in the fountain basin filling mode, the water may flow out in an orderly cascading pattern, adding one more water display setting and providing more water contact to the bodies of children as they cool off and splash one another.

The kiddie pool may have an option to detach the fountain basin from the pedestal of the main basin and place the fountain basin in an upside-down orientation nested over the pedestal to envelop the pedestal making the pool more compact for storage. This feature of nesting the fountain basin over the pedestal in an upside-down manner serves as a convenient transportation and or storage mechanism. First, the feature reduces the height dimension of the kiddie pool and eliminates possible separation or loss of the fountain basin during transportation or storage. Second, multiple kiddie pools can be stacked together. In addition, the integrated hose or tubing can be easily removable from the bottom of the main basin and be placed within the main basin for easy transportation and storage.

Additionally, the quick connect/disconnect fitting or attachment enables the user to connect or disconnect easily.

Although the present disclosure describes the invention in the context of a kiddie pool, the inventive features described in here are not limited to a kiddie pool and are applicable in other contexts.

DETAILED DESCRIPTION

Figure 1:
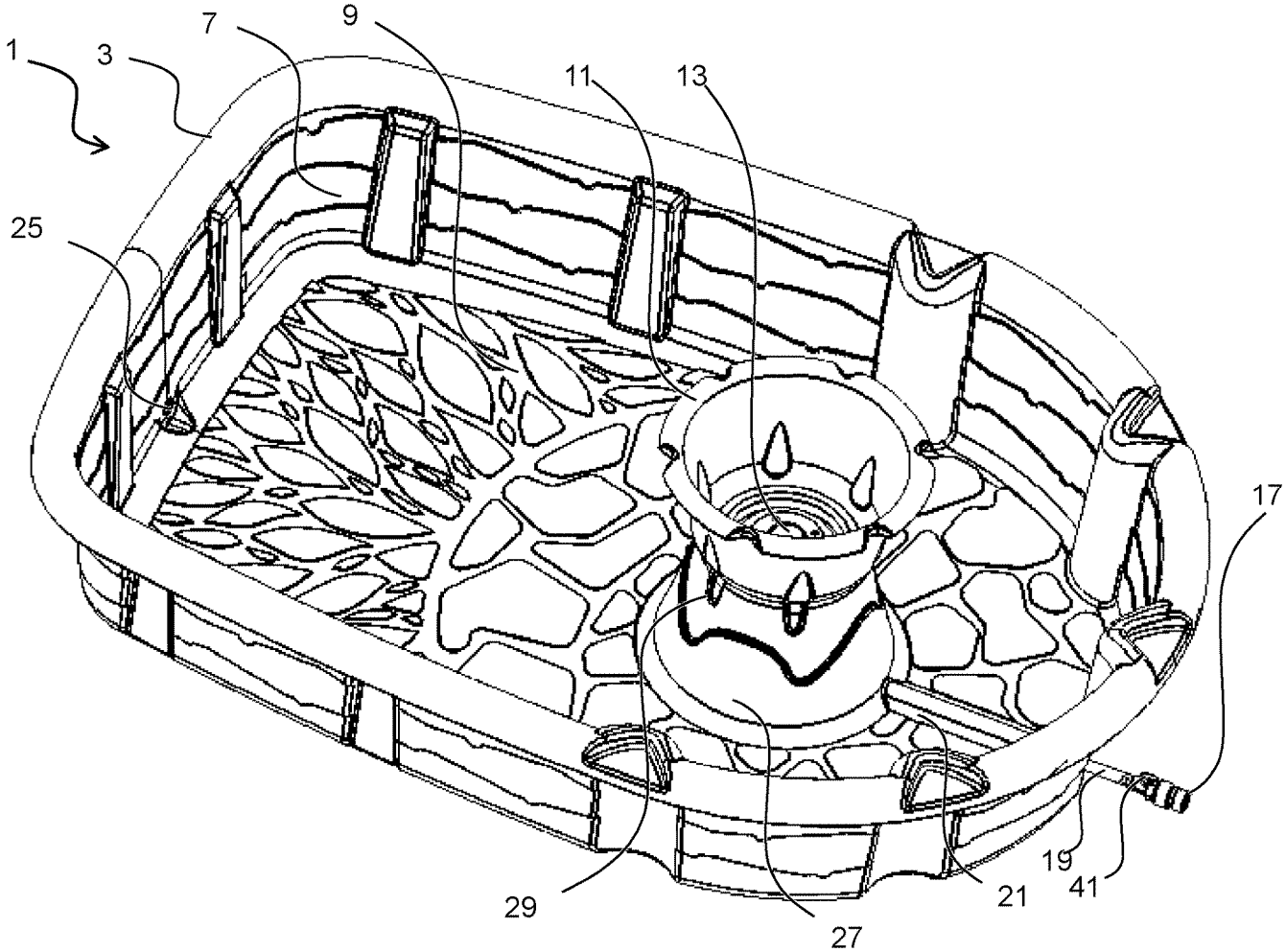
FIG. 1 illustrates a perspective top view of a kiddie pool in accordance with the present disclosure.
Figure 2:
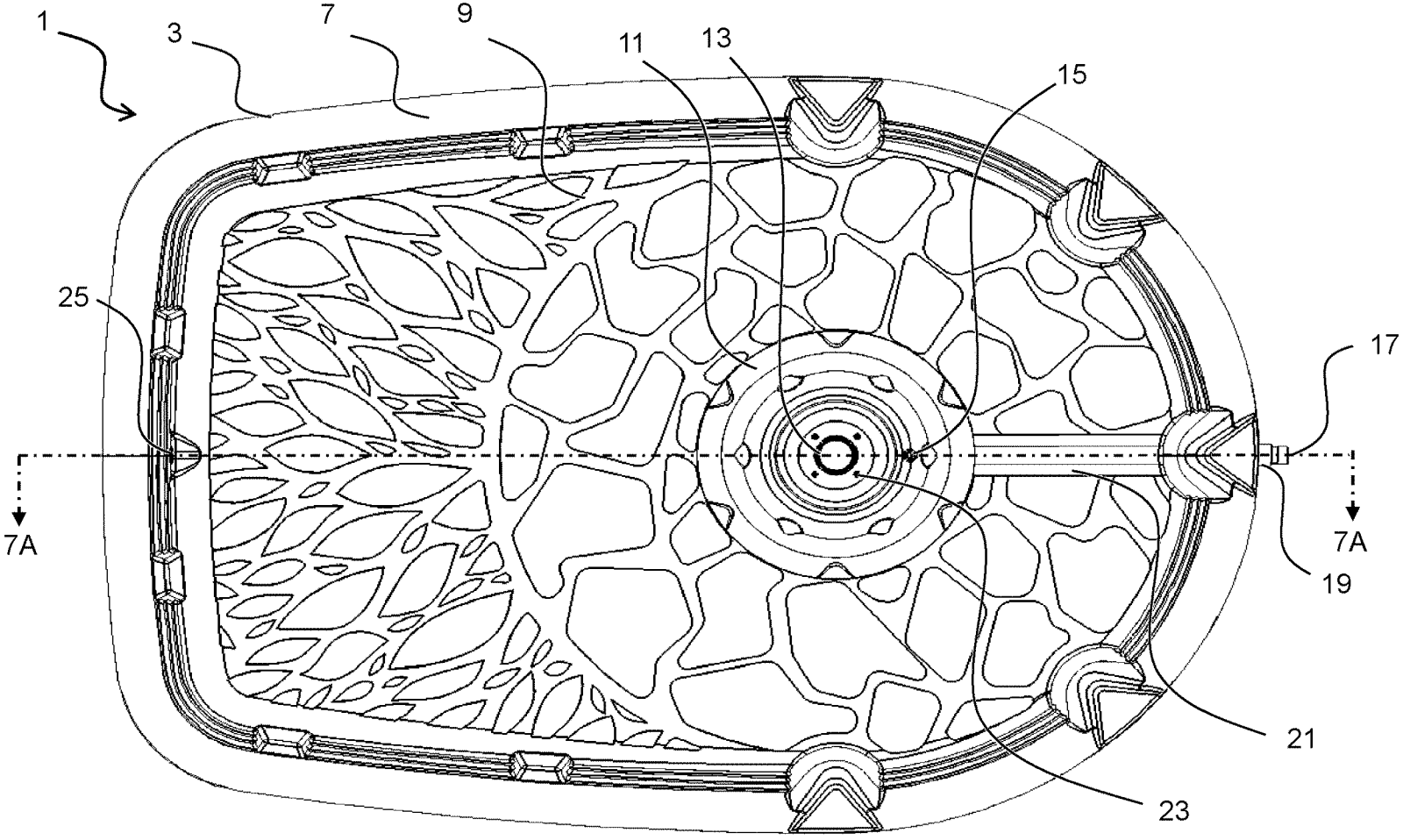
FIG. 2 illustrates a top view of the exemplary kiddie pool of FIG. 1.
Figure 3:
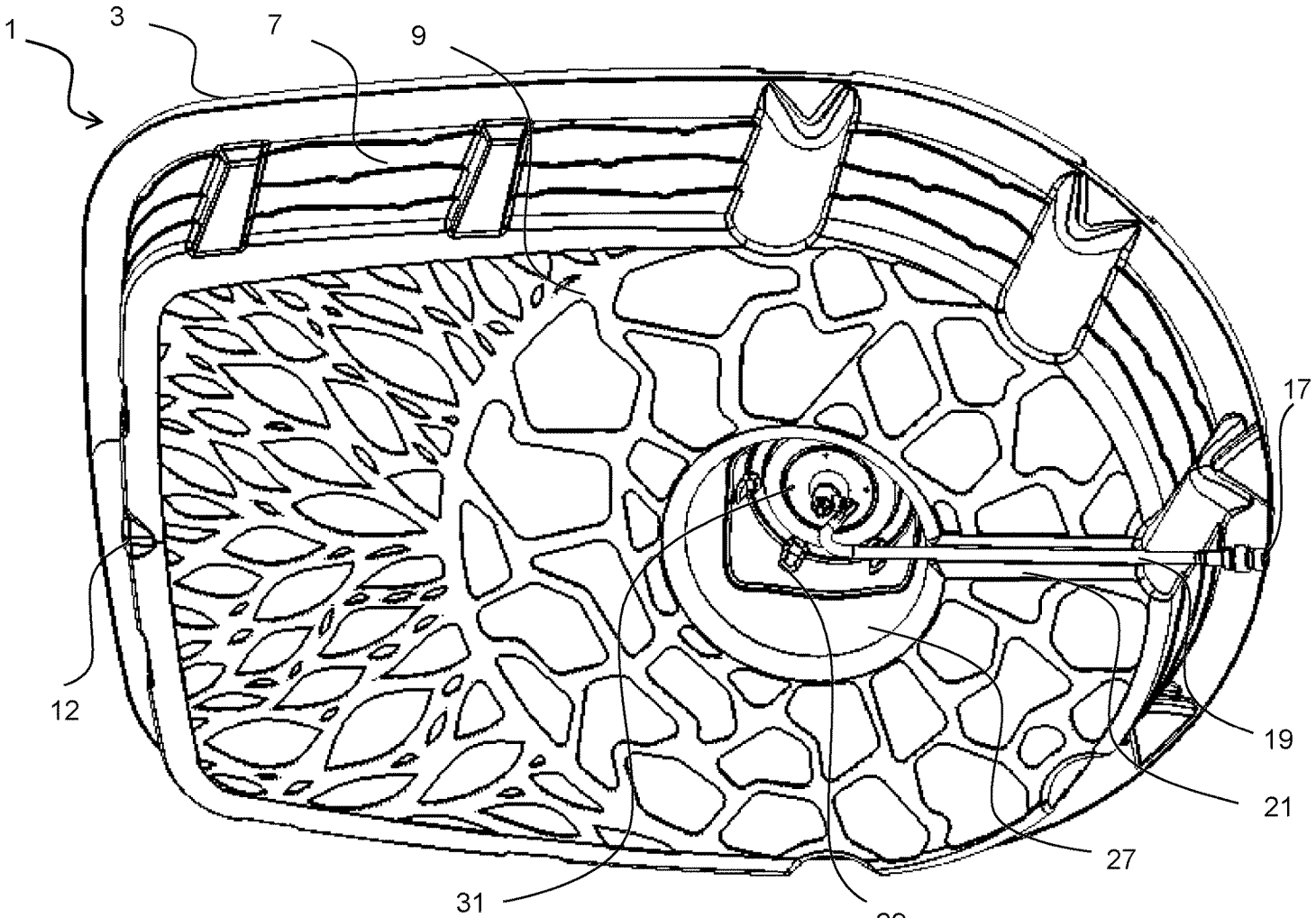
FIG. 3 illustrates a perspective bottom view of the exemplary kiddie pool of FIG. 1.
Figure 4:
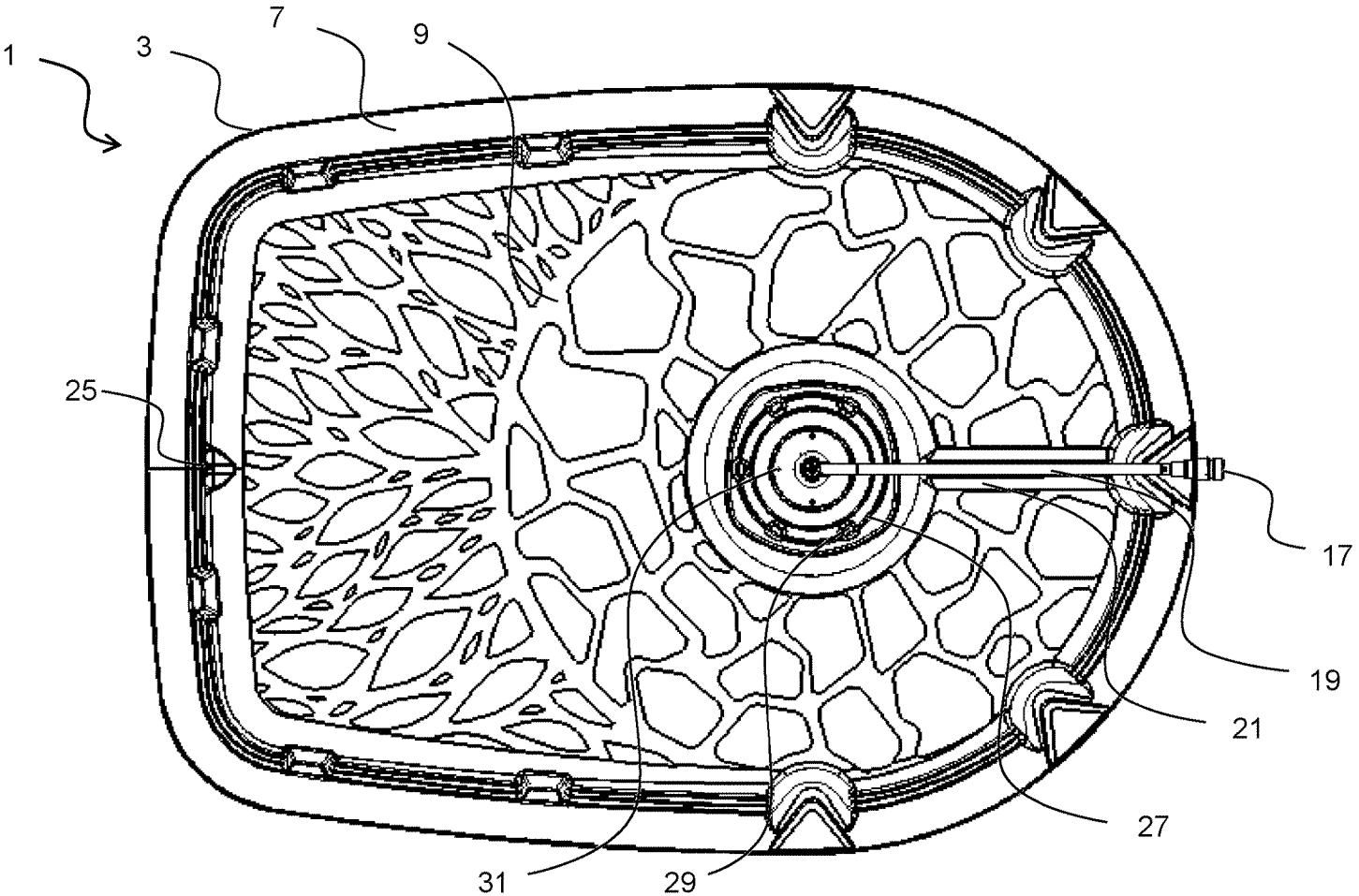
FIG. 4 illustrates a bottom view of the exemplary kiddie pool of FIG. 1.

FIGS. 1-4 illustrate an exemplary kiddie pool 1. The kiddie pool 1 includes two main components: a main basin 3 and a fountain basin 11. The main basin 3 includes a floor 9 and a perimeter wall 7. The fountain basin 11 is disposed above the floor 9 within a perimeter of the perimeter wall 7. The fountain basin 11 includes at least one fountain opening 13 and at least one drainage opening 15. The fountain opening 13 of the fountain basin 11 may be connected to a pressurized water source such that water from the pressurized water source flows from the fountain opening 13.

The pool 1 may additionally include a hose or tubing 19 that extends at a first end from the perimeter of the pool 1 through a radial groove 21 of the floor 9 to a second end that operably connects to the fountain opening 13 of the fountain basin 11. The hose or tubing 19 may include a fitting 17 to connect to the pressurized water source such that water flows from the pressurized water source through the hose or tubing 19 and to the fountain opening 13 of the fountain basin 11. The fountain basin 11 and the integrated hose or tubing 19 are removably attachable to the main basin 3.

The pool 1 may also include a drain plug 25 for preventing water in the pool from draining when the drain plug 25 is on or allowing quick and easy draining of the water from the pool 1 when the drain plug is off. Because of the unique location of the drain plug 25 on the bottom end of the floor 9 within the perimeter wall 7 of the main basin 3, the drain plug 25 is not exposed to the normal wear and tear from being abraded by the surface on which the pool 1 rests. The floor 9 may also be shaped (e.g., angled) relative to the drain plug 25 to direct water towards the drain plug 25 to assist in draining when the drain plug 25 is off. Further, the drain plug is latched on the exterior of the perimeter wall 7 of the main basin 3, and thus, allows users to easily access and open the plug without having to reach to the bottom of the floor of the kiddie pool while it is full.

The main basin 3 may include a pedestal 27. The pedestal 27 of the main basin 3 may be hollow. The hose or tubing 19 may be routed through the radial groove 21 and the hollow of the pedestal 27 to the fountain opening 13 of the fountain basin 11. When the quick disconnect fitting 17 of the hose or tubing 19 is connected to the pressurized water source, water is directed under the main basin 3 and up through the pedestal 27 to the fountain basin 11. Pressurized water from the pressurized water source then sprays upward to create the fountain.

The pool 1 may additionally include a flow control valve 41 at the end attached to the integrated hose or tubing 19. The flow control valve allows the user to adjust the volume or pressure of water coming in to the pool 1 without having do so from the home's water spigot.

Figure 5B:
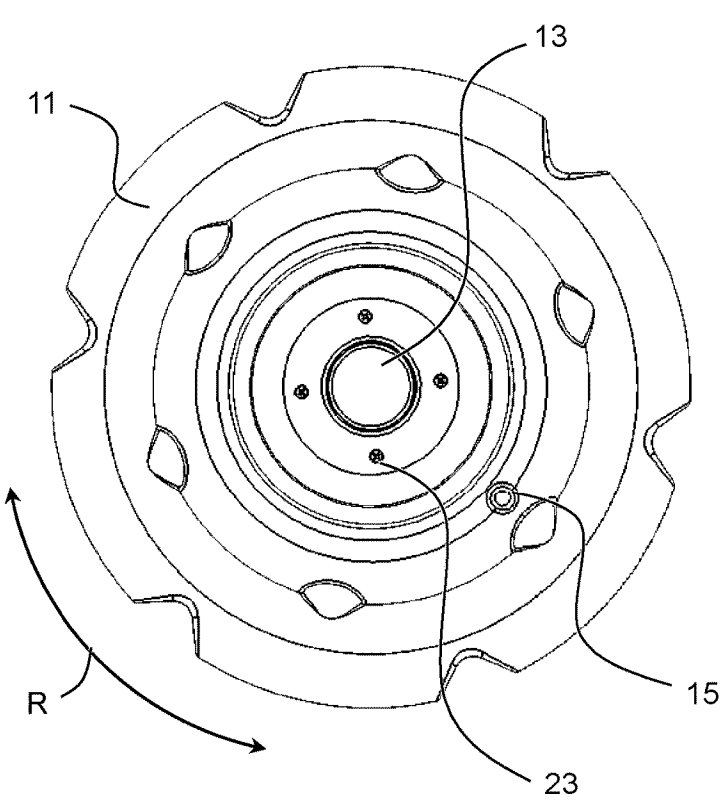
FIG. 5B illustrates a top view of the exemplary fountain basin of FIG. 5A in the upside-up orientation.
Figure 5A:
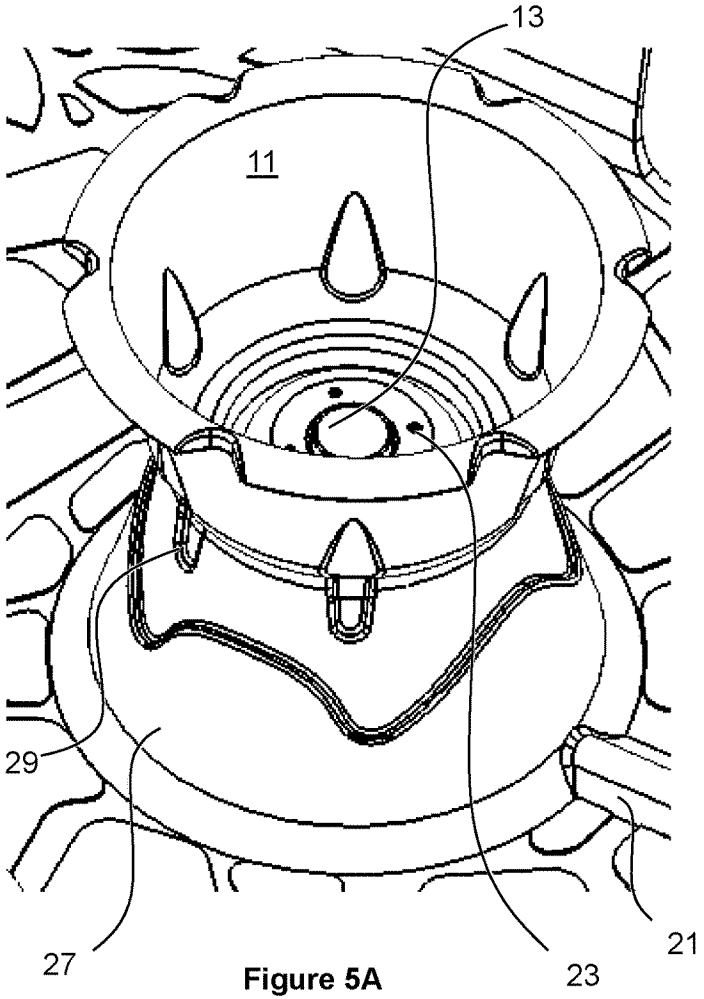
FIG. 5A illustrates a magnified perspective view of an exemplary fountain basin in an upside-up orientation and attached to a pedestal of a main basin of the exemplary kiddie pool of FIG. 1.
Figure 5C:
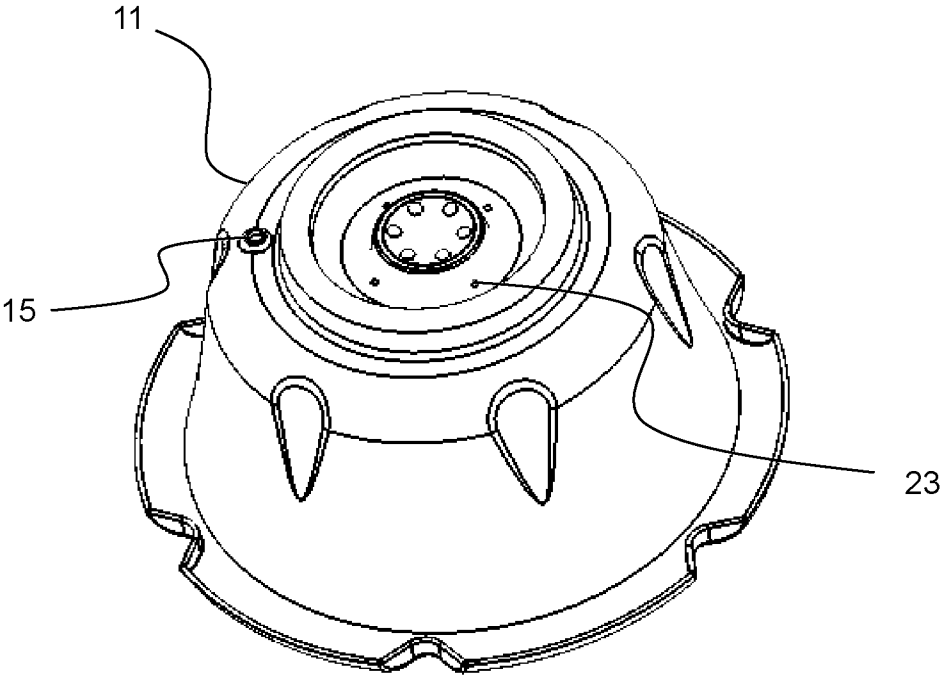
FIG. 5C illustrates a magnified perspective view of the exemplary fountain basin of FIG. 5A in an upside-down orientation.

FIG. 5A illustrates the fountain basin 11 in an upside-up orientation attached to the pedestal 27 of the main basin 3 in a removable manner. FIG. 5B illustrates a top view of the fountain basin 11 upside-up and a rotation direction R of the fountain basin 11. FIG. 5C illustrates the fountain basin 11 in an upside-down orientation and unattached from the pedestal 27. The fountain basin 11 may be removably attached to the main basin 3 via the pedestal 27 such that the fountain basin 11 is disposed above the pedestal 27. The fountain basin 11 includes an engagement mechanism 23. The engagement mechanism 23 may include a plate and/or fasteners such as screws, adhesives, etc. The pedestal 27 may also include an engagement mechanism 31 (see FIG. 6 below) that may include a plate and/or fasteners such as screws, adhesives, etc. Hence, the fountain basin 11 is removably attachable to the pedestal 27 of the main basin 3 via the engagement mechanism 23 and the engagement mechanism 31. In the illustrated embodiments, the engagement mechanism 23 and/or the engagement mechanism 31 include plates that are rotably connected and that, therefore, may rotate relative to each other.

Figure 6:
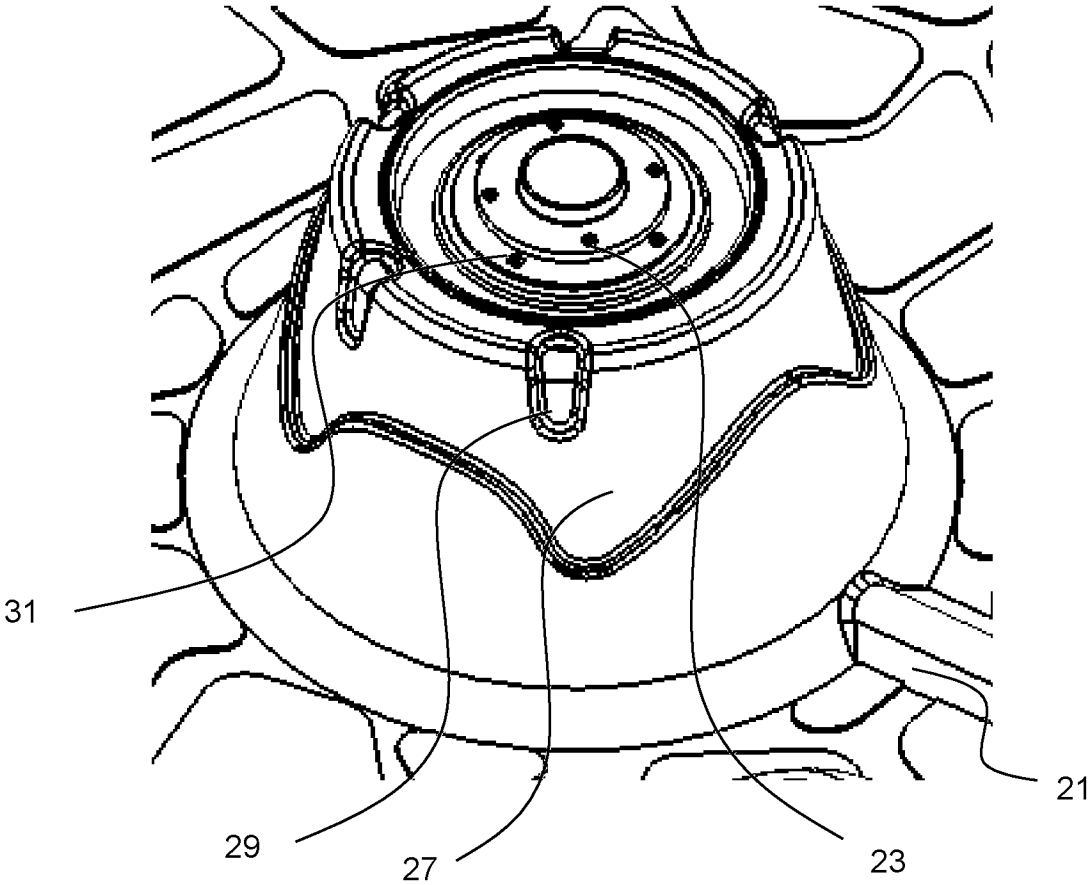
FIG. 6 illustrates a magnified perspective top view of an exemplary pedestal of the main basin of the exemplary kiddie pool of FIG. 1.

FIG. 6 illustrates the pedestal 27 of the main basin 3 in more detail. The pedestal 27 includes the engagement mechanism 31. The pedestal 27 also includes at least one drainage opening 29 that aligns or does not align with the drainage opening 15 (see FIG. 5C) of the fountain basin 11 as discussed below to drain the fountain basin 11.

In continued reference to FIGS. 5A-5C and FIG. 6, the fountain basin 11 is rotatable in the direction R relative to the main basin 3 to at least two modes: a) a main basin filling mode in which the drainage opening 15 of the fountain basin 11 is unobstructed such that water from the fountain basin 11 drains into the main basin 3 through the drainage opening 15 of the fountain basin 11, and b) a fountain basin filling mode in which the drainage opening 15 of the fountain basin 11 is obstructed such that water from the fountain basin 11 does not drain from the fountain basin 11 into the main basin 3 through the drainage opening 15.

Figure 7A:
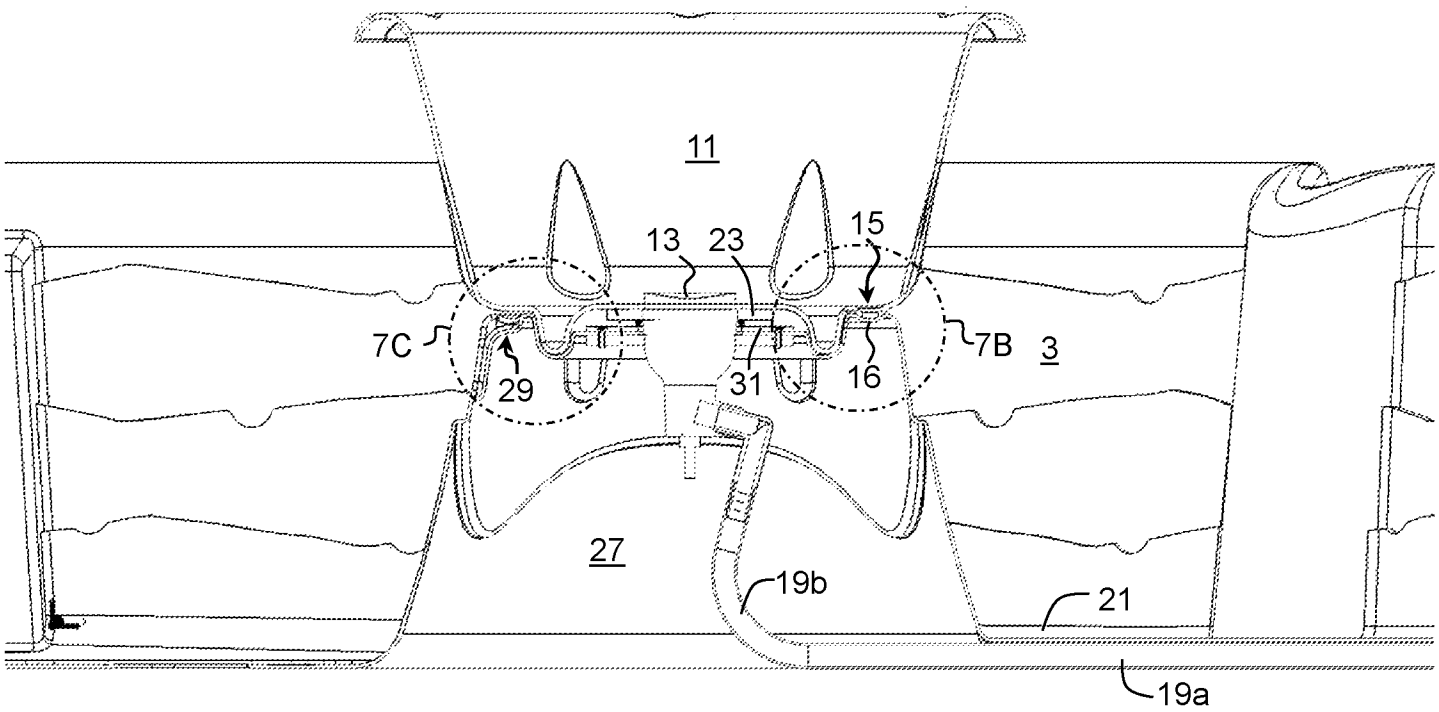
FIG. 7A illustrates a cross-sectional view of the exemplary kiddie pool of FIG. 1.

FIG. 7A illustrates a cross sectional view of the pool 1 in the fountain basin filling mode. In the illustrated embodiment, the drainage opening 15 of the fountain basin 11 is obstructed by the portion 16 of the pedestal 27 such that water from the fountain basin 11 cannot drain from the fountain basin 11 into the main basin 3 through the drainage opening 15.

Figure 7B:
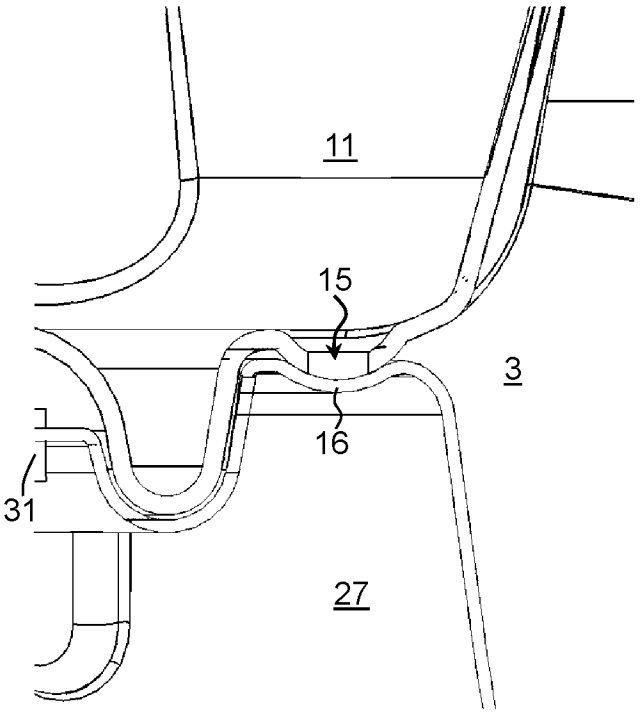
FIG. 7B illustrates a magnified view of the cross-sectional view of FIG. 7A.

FIG. 7B illustrates a magnified view of the relevant area including the drainage opening 15. Notice that, in the illustrated embodiment of FIG. 7B, the drainage opening 15 of the fountain basin 11 is obstructed by the portion 16 of the pedestal 27 such that water from the fountain basin 11 cannot drain from the fountain basin 11 into the main basin 3 through the drainage opening 15.

Figure 7C:
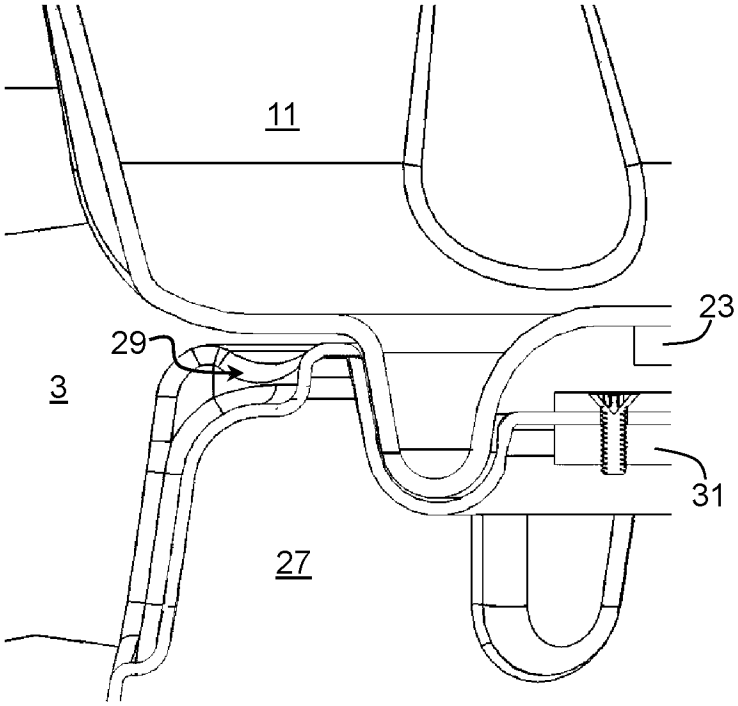
FIG. 7C illustrates another magnified view of the cross-sectional view of FIG. 7A.

FIG. 7C illustrates a magnified view of the area of the main basin 3 and the fountain basin 11 that is relevant in main basin filling mode. In main basin filling mode, the drainage opening 15 of the fountain basin, instead of being obstructed by the portion 16 of the pedestal 27, the drainage opening 15 is aligned with the opening 29 of the pedestal 27. The opening 29 does not obstruct the drainage opening 15. The drainage opening 15 is unobstructed and, thus, water from the fountain basin 11 may drain from the fountain basin 11 into the main basin 3 through the drainage opening 15 and the opening 29.

Returning to FIG. 7A, the fountain basin 11 may be connected to the hose or tubing 19 for spraying water from the pressurized water source. The integrated hose or tubing 19 includes a horizontal portion 19*a* that extends from the perimeter of the pool 1 through the radial groove 21 of the floor 9 and a vertical portion 19*b* that extends through the pedestal 27 to the fountain opening 13 of the fountain basin 11.

The fountain opening 13 of the fountain basin 11 may include two or more fountain openings, each fountain opening providing different spray or fountain patterns. The fountain basin 11 may be rotated relative to the pedestal 27 or the main basin 3 to select or change the spray or fountain pattern. Spray and/or fountain patterns may include a virtually infinite number of different patterns including fan, shower, flat, cone, mist, jet, wave, etc.

In one embodiment, the engagement mechanism 23 and the engagement mechanism 31 cooperate with each other so that rotating the fountain basin 11, in addition to changing the spray pattern, also produces a clicking sound that provides feedback to the user.

Figure 8A:
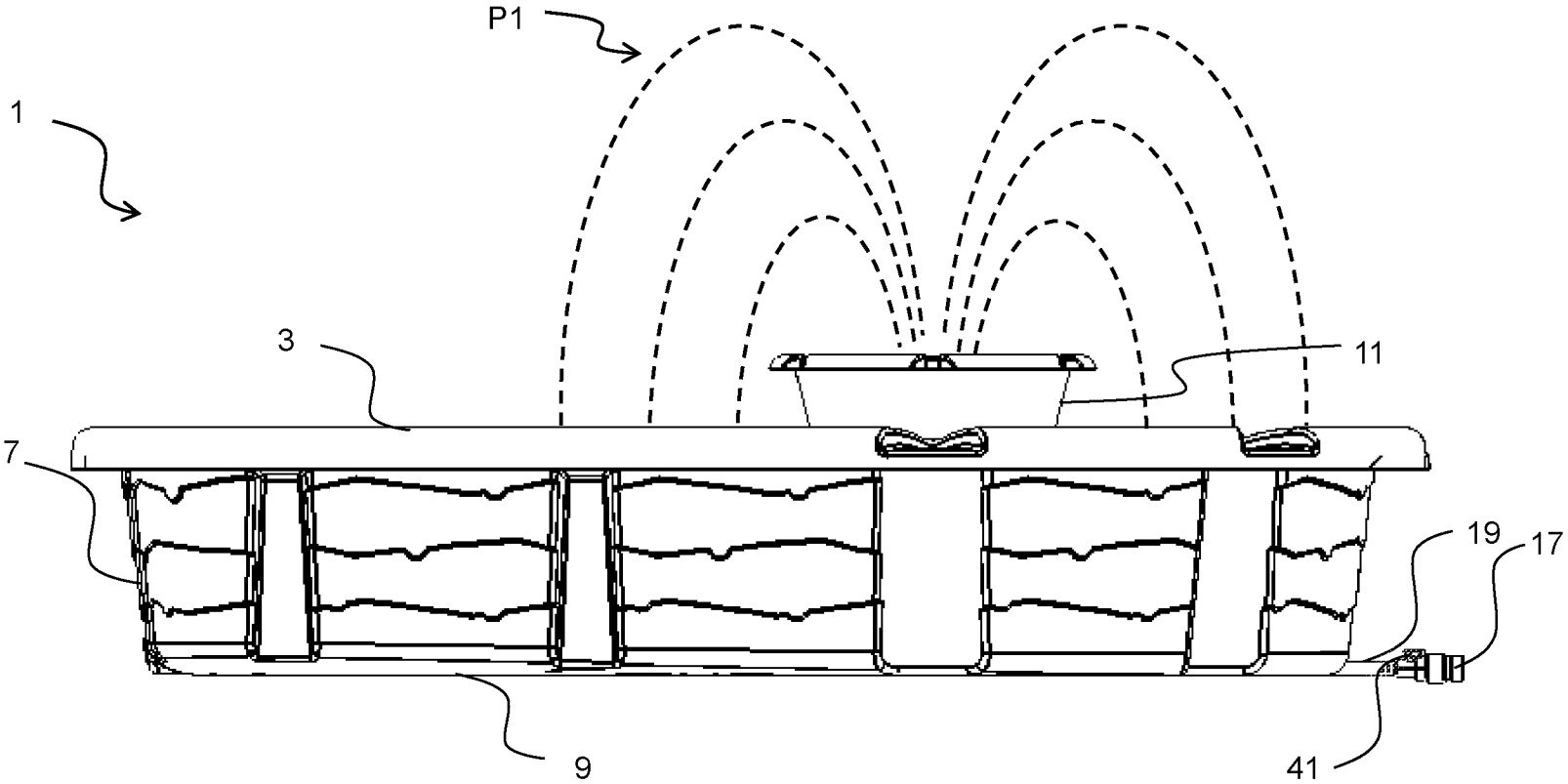
FIG. 8A illustrates the exemplary kiddie pool of FIG. 1 in a main basin filling mode, spraying water in a first spray/fountain pattern.

FIG. 8A illustrates the pool 1 in the main basin filling mode in which the at least one draining opening 29 of the main basin 3 aligns with the drainage opening 15 of the fountain basin 11 such that the water from the fountain basin 11 drains into the main basin 3 through the drainage opening 15 of the fountain basin 11 and the drainage opening 29 of the main basin 3. In the embodiment of FIG. 8A, water from the pressurized water source flows from a first fountain opening 13 forming a water fountain pattern P1 above the fountain basin 11 such that at least some water from the water fountain fills the main basin 3.

Figure 8B:
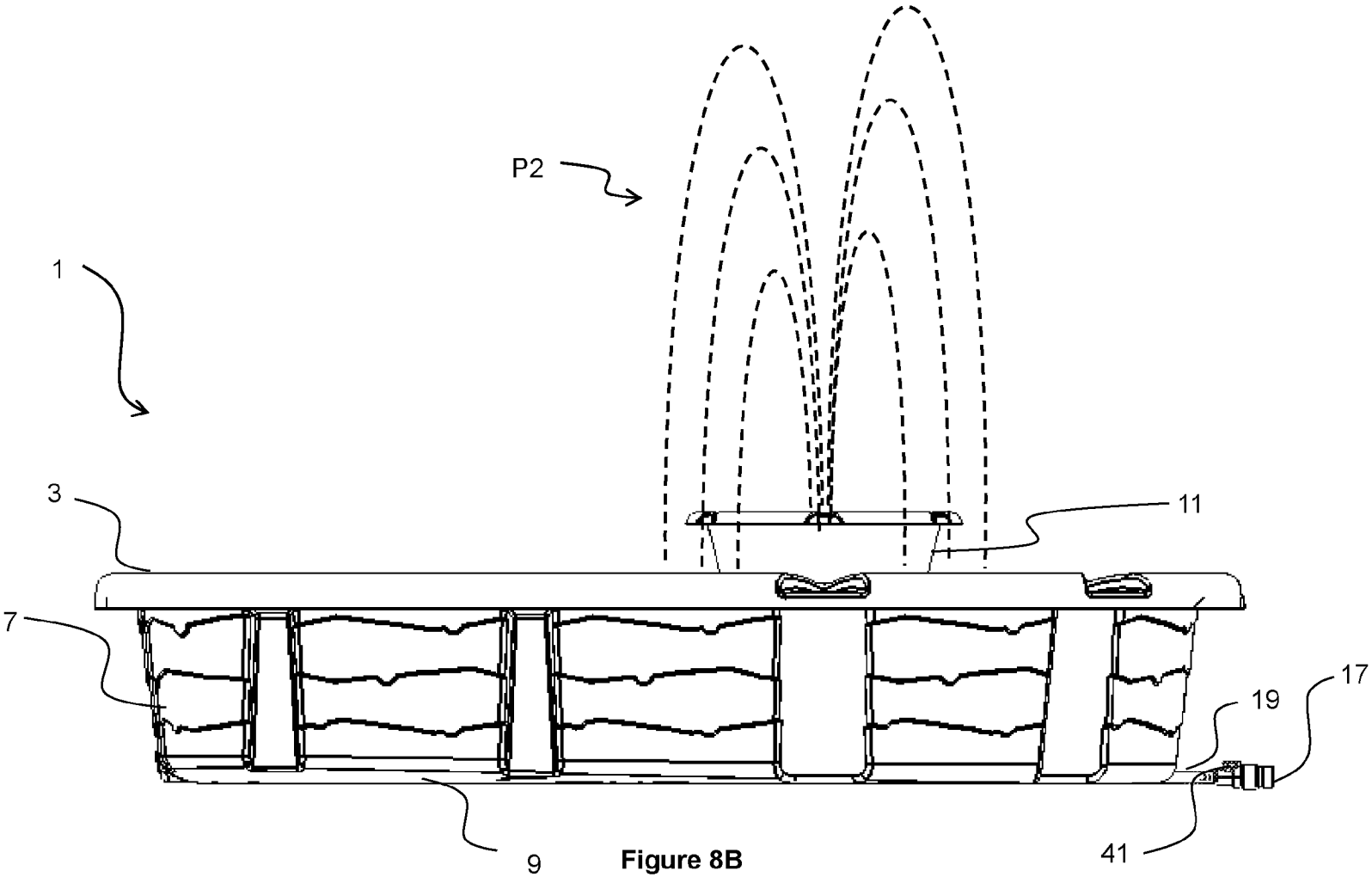
FIG. 8B illustrates the exemplary kiddie pool of FIG. 1 in a main basin filling mode, spraying water in a second spray/fountain pattern.

FIG. 8B illustrates the pool 1 in the main basin filling mode similar to FIG. 8A. In the embodiment of FIG. 8B, however, water from the pressurized water source flows from a second fountain opening 13 forming a water fountain pattern P2 above the fountain basin 11 such that at least some water from the water fountain fills the main basin 3. The water fountain pattern P2 is different from the first pattern P1 of FIG. 8A. In between the embodiments of FIG. 8A and FIG. 8B a user rotated the fountain basin 11 relative to the pedestal 27 or the main basin 3 to select or change the fountain opening and thus the spray or fountain pattern from P1 to P2.

Figure 9:
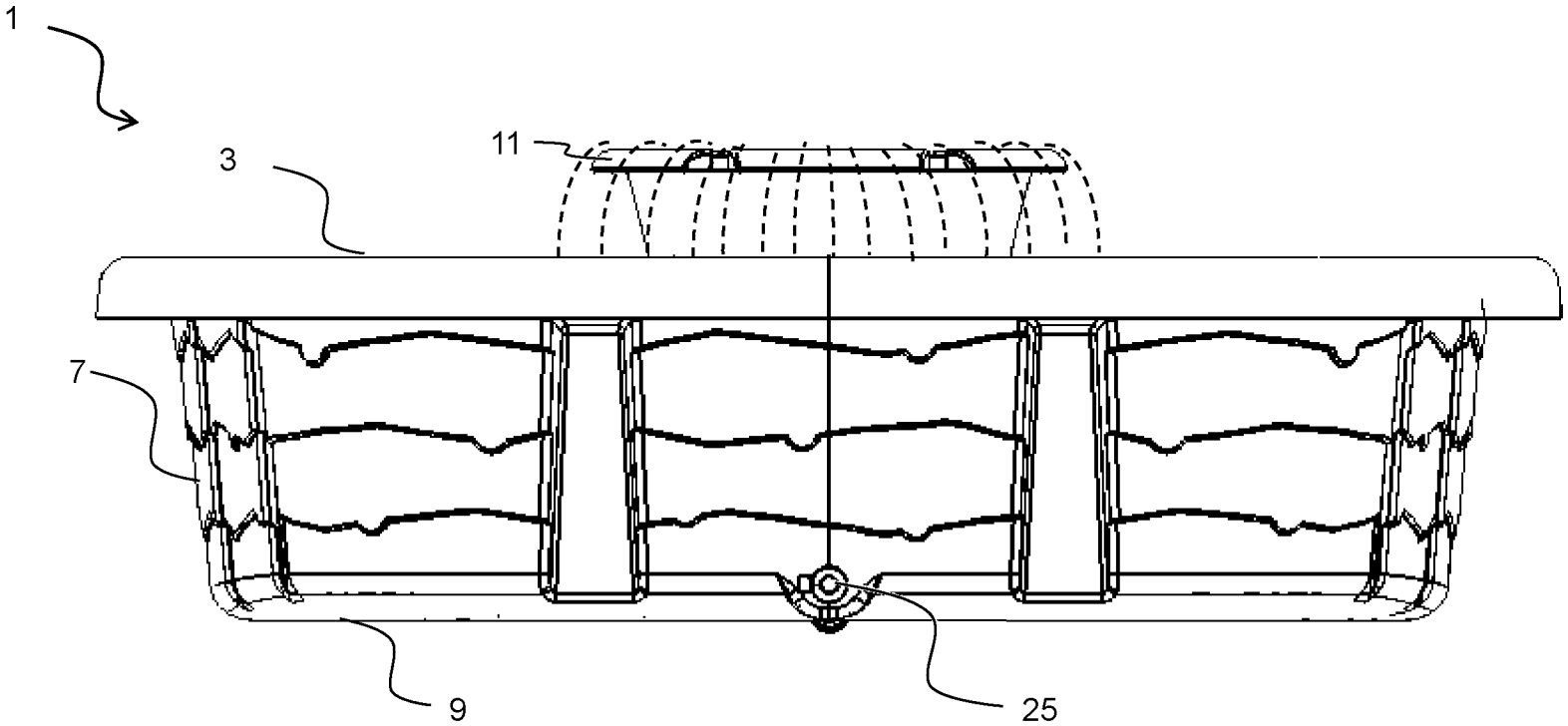
FIG. 9 illustrates the exemplary kiddie pool of FIG. 1 in a fountain basin filling mode.

FIG. 9 illustrates the exemplary pool 1 in the fountain basin filling mode in which the at least one drainage opening 29 of the pedestal 27 of the main basin 3 does not align with the drainage opening 15 of the fountain basin 11 (see FIG. 7A). Instead the drainage opening 15 of the fountain basin 11 is obstructed. Therefore, water from the fountain basin 11 does not drain into the main basin 3 through the drainage opening 15 of the fountain basin 11 and the drainage opening 29 of the main basin 3. In the fountain basin filling mode, at least some water from the pressurized water source pools in the fountain basin 11 filling the fountain basin 11. Water eventually completely fills the fountain basin 11 and water cascades off the top portion of the fountain basin 11 into the main basin 3.

Figure 10:
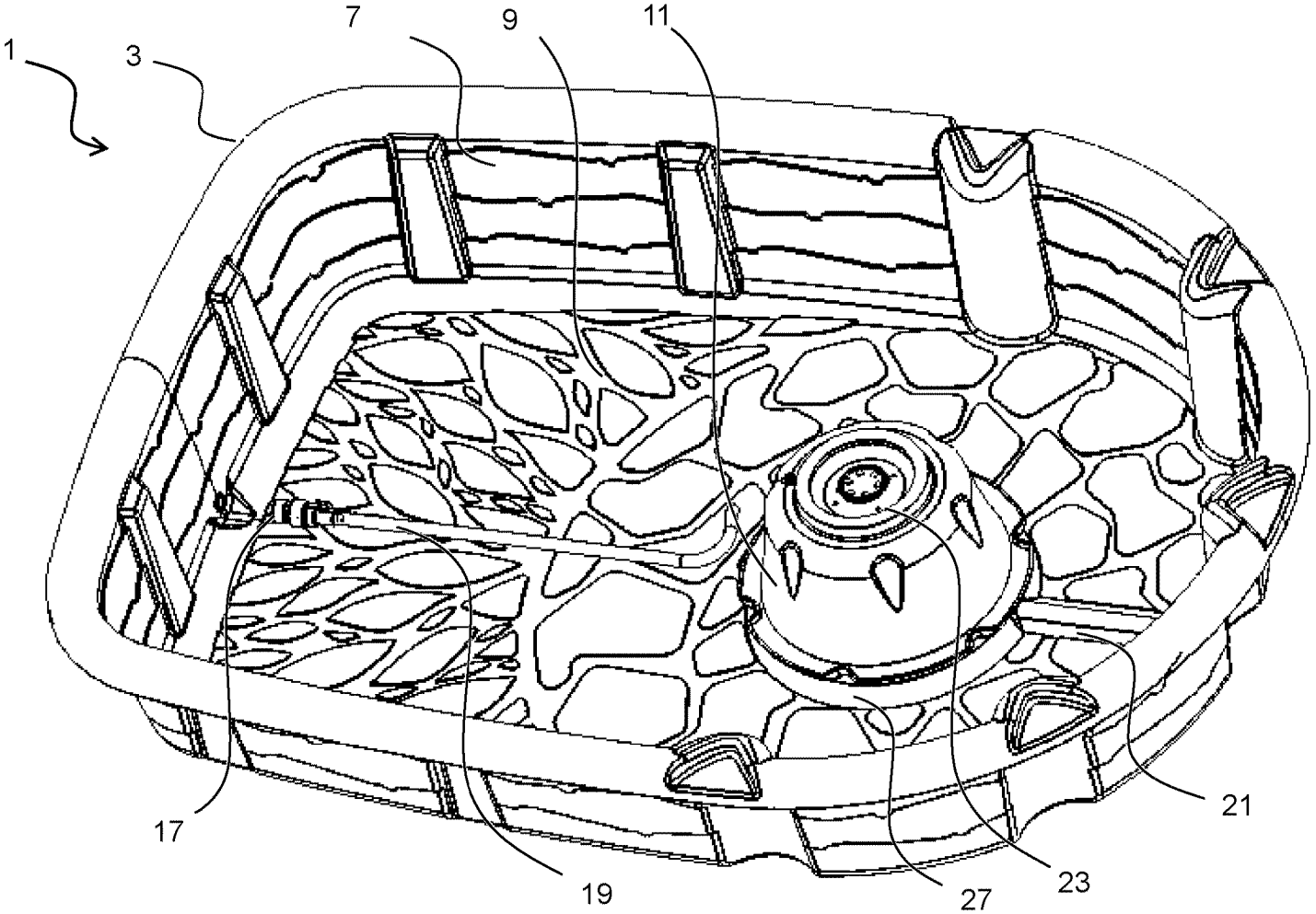
FIG. 10 illustrates a top perspective view of the exemplary kiddie pool of FIG. 1 with the fountain basin nested to the pedestal.

FIG. 10 illustrates the exemplary pool 1 with the fountain basin 11 turned upside-down and nested to the pedestal 27. In addition, the hose or tubing 19 may be easily removed from the groove 21 and be placed within the main basin 3. This nesting feature of the fountain basin 11 over the pedestal 27 of the main basin 3 reduces the height dimension of the kiddie pool 1 and possible separation or loss of the fountain basin 11 during packaging, transportation or storage of the pool 1.

Figure 11:
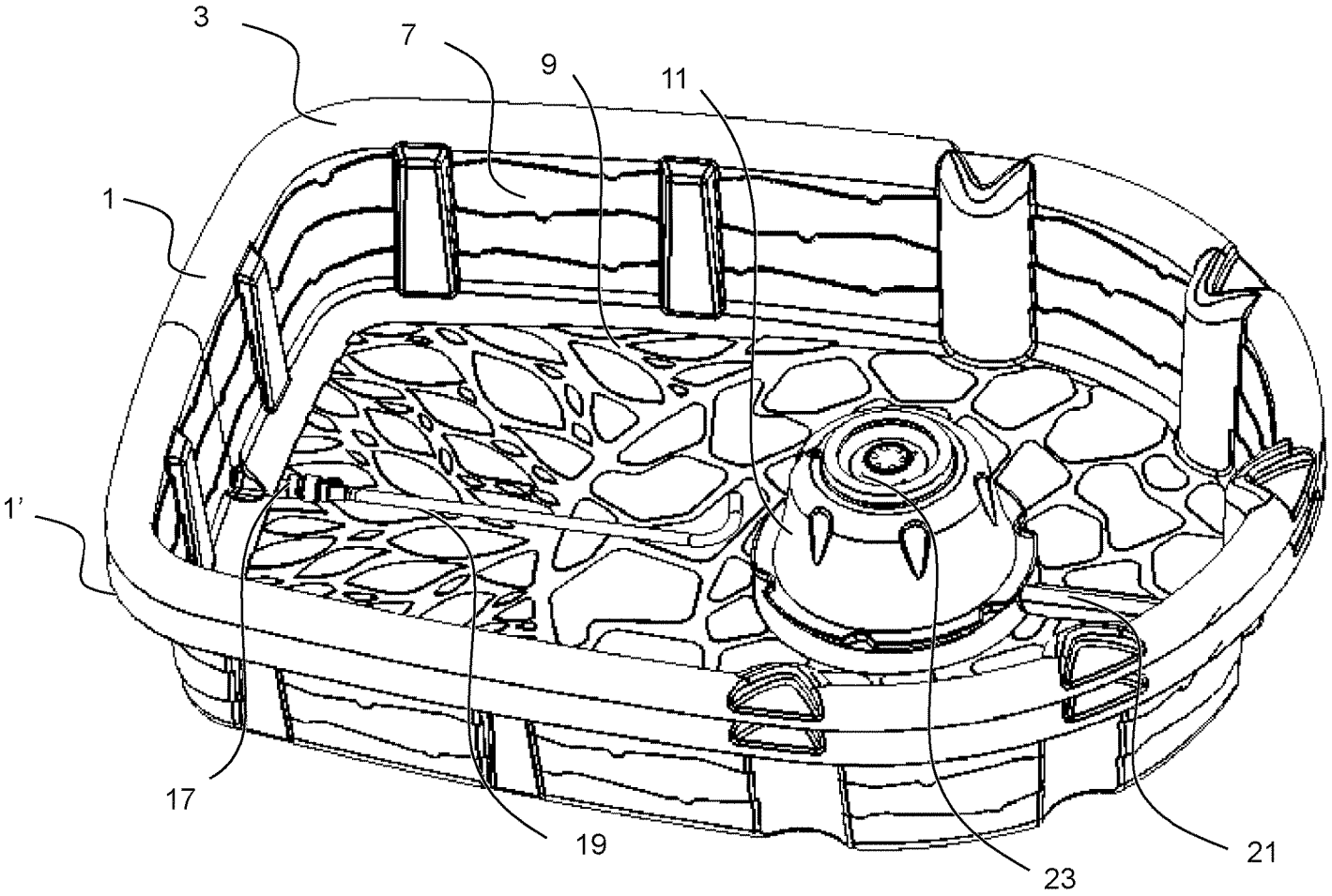
FIG. 11 illustrates a top perspective view of two of the exemplary kiddie pool of FIG. 1 nested together.

FIG. 11 illustrates the exemplary pool 1 nested within another pool 1'. With the fountain basin 11 turned upside-down and nested to the pedestal 27, multiple pools 1, 1', etc. may be stacked together.

While example systems, methods, and so on, have been illustrated by describing examples, and while the examples have been described in considerable detail, it is not the intention to restrict or in any way limit the scope of the appended claims to such detail. It is, of course, not possible to describe every conceivable combination of components or methodologies for purposes of describing the systems, methods, and so on, described herein. Additional advantages and modifications will readily appear to those skilled in the art. Therefore, the invention is not limited to the specific details, and illustrative examples shown or described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (3d ed. 1995).

What is claimed is:

1. A portable kiddie pool comprising:

a main basin including a floor, a perimeter wall defining a perimeter of the pool, and a hollow pedestal, the floor including a radial groove extending from the perimeter to the hollow pedestal;

a fountain basin including at least one fountain opening, the fountain basin rotatably attached to the hollow pedestal; and tubing extending through the radial groove from the perimeter to the fountain basin, the tubing including a fitting configured to connect to a pressurized water source and being in fluid communication with the at least one fountain opening of the fountain basin such that water from the pressurized water source flows from the pressurized water source through the tubing and to the fountain opening of the fountain basin, wherein rotation of the fountain basin relative the hollow pedestal selectively releases a flow of pressurized water from the at least one fountain opening to create a spray or fountain pattern.

2. The portable kiddie pool of claim 1, wherein the fountain basin and the tubing are removably attachable to the main basin.

3. The portable kiddie pool of claim 1, wherein, the at least one fountain opening of the fountain basin includes a first fountain opening and a second fountain opening different from the first fountain opening and the spray or fountain pattern is a first spray or fountain pattern, and wherein the fountain basin is rotatably adjustable between a first position in which water from the pressurized water source flows from the first fountain opening and a second position in which water from the pressurized water source flows from the second fountain opening, wherein the first fountain opening causes water from the pressurized water source flowing through the first fountain opening to flow in the first spray or fountain pattern and the second fountain opening causes water from the pressurized water source flowing through the second fountain opening to flow in a second spray or fountain pattern different from the first spray or fountain pattern.

4. The portable kiddie pool of claim 1, wherein the fitting includes a connector configured to connect or disconnect from the pressurized water source without rotation of the tubing or the pressurized water source.

5. The portable kiddie pool of claim 1, further comprising a drain plug configured to engage a drain on an exterior side of the perimeter wall of the main basin.

6. The portable kiddie pool of claim 1, wherein the fountain basin includes a hollow volume that is configured to receive the pedestal when the fountain basin is placed when installed in an upside-down orientation such that the fountain basin substantially envelops the pedestal.

7. The portable kiddie pool of claim 1, wherein the fountain basin is configured to retain water and selectively discharge water into the main basin.

8. A portable kiddie pool set comprising:

a main basin including a floor, a pedestal, and a perimeter wall defining a perimeter of the pool, the floor including a radial groove extending from the perimeter of the pool to the pedestal;

a fountain basin including a hollow volume and at least one fountain opening and being rotatably and removably attached to the pedestal; and tubing including a first portion configured to extend horizontally through the radial groove from the perimeter of the pool to the pedestal, a second portion configured to extend vertically through the pedestal such that a first end of the tubing is in fluid communication with the at least one fountain opening of the fountain basin, and a fitting attached to a second end of the tubing and configured to engage in fluid communication with a pressurized water source such that water from the pressurized water source flows from the pressurized water source through the tubing and to the fountain opening of the fountain basin, wherein, when in a functional configuration, the fountain basin is rotatably attached to the pedestal and rotation of the fountain basin relative the pedestal selectively releases a flow of pressurized water from the at least one fountain opening to create a spray or fountain pattern, wherein, when in a storage configuration, the fountain basin is detached from the pedestal and the fountain basin is placed over the pedestal in an upside-down orientation such that at least a portion of pedestal is positioned within the hollow volume of the fountain basin.

9. The portable kiddie pool set of claim 8, wherein the at least one fountain opening of the fountain basin includes a first fountain opening and a second fountain opening different from the first fountain opening and the spray or fountain pattern is a first spray or fountain pattern, and wherein the fountain basin is adjustable between a first position in which water from the pressurized water source flows from the first fountain opening and a second position in which water from the pressurized water source flows from the second fountain opening, wherein the first fountain opening causes water from the pressurized water source flowing through the first fountain opening to flow in the first spray or fountain pattern and the second fountain opening causes water from the pressurized water source flowing through the second fountain opening to flow in a second spray or fountain pattern different from the first spray or fountain pattern.

10. The portable kiddie pool set of claim 8, wherein the fountain basin is configured to retain water and selectively discharge water into the main basin.

11. A portable kiddie pool set comprising:

a main basin including a floor, a perimeter wall defining a perimeter of the pool, and a pedestal, the floor including a radial groove extending from the perimeter of the pool to the pedestal; and a fountain basin including a hollow volume, at least one fountain opening, and an engagement mechanism configured to rotatably and releasably engage the pedestal; and tubing extending from the perimeter of the pool and through the radial groove and the pedestal to the at least one fountain opening of the fountain basin, the tubing including a fitting configured to connect to a pressurized water source such that water from the pressurized water source flows from the pressurized water source through the tubing and to the fountain opening of the fountain basin, wherein rotation of the fountain basin relative the pedestal selectively releases a flow of pressurized water from the at least one fountain opening to create a spray or fountain pattern, and wherein the hollow volume of the fountain basin is configured to receive the pedestal when the fountain basin is placed in an upside-down configuration such that the fountain basin substantially envelops the pedestal.

12. The portable kiddie pool set of claim 11, wherein the fountain basin and the tubing are removably attachable to the main basin.

13. The portable kiddie pool set of claim 11, wherein the pedestal includes an engagement mechanism configured to engage the engagement mechanism of the fountain basin such that the fountain basin is disposed above the pedestal with an open face of the hollow volume of the fountain basin facing away from the pedestal.

14. The portable kiddie pool set of claim 11, wherein, the at least one fountain opening of the fountain basin includes a first fountain opening and a second fountain opening different from the first fountain opening and the spray or fountain pattern is a first spray or fountain pattern, and wherein the fountain basin is rotatably adjustable between the first position in which water from the pressurized water source flows from the first fountain opening and a second position in which water from the pressurized water source flows from the second fountain opening, wherein the first fountain opening causes water from the pressurized water source flowing through the first fountain opening to flow in a first spray or fountain pattern and the second fountain opening causes water from the pressurized water source flowing through the second fountain opening to flow in a second spray or fountain pattern different from the first spray or fountain pattern.

15. The portable kiddie pool set of claim 11, wherein the fitting includes a connector configured to connect or disconnect from the pressurized water source without rotation of the tubing or the pressurized water source.

16. The portable kiddie pool set of claim 11, further comprising a drain plug configured to engage a drain on an exterior side of the perimeter wall of the main basin.

17. The portable kiddie pool set of claim 11, wherein the fountain basin is configured to retain water and selectively discharge water into the main basin.

* * * * *